United States Patent [19]

Nohara

[11] Patent Number: 4,642,059

[45] Date of Patent: Feb. 10, 1987

[54] MARINE CONTRA-ROTATING PROPELLER APPARATUS

[75] Inventor: Hiroshi Nohara, Nagasaki, Japan

[73] Assignee: Mitsubishi Jukogyo Kabushiki Kaisha, Japan

[21] Appl. No.: 630,959

[22] Filed: Jul. 16, 1984

[30] Foreign Application Priority Data

Jul. 18, 1983 [JP] Japan ..... 58-110128[U]

[51] Int. Cl.[4] ..... B63H 23/00

[52] U.S. Cl. ..... 440/75; 440/81; 416/129

[58] Field of Search ..... 440/75, 80, 81; 416/128, 129, 124, 127, 170 R; 192/55, 56, 3.51; 74/664, 665 A, 665 D

[56] References Cited

U.S. PATENT DOCUMENTS 1,381,939 6/1921 Small ..... 416/129

3,545,585 12/1970 Eaton, Jr. ..... 192/55

FOREIGN PATENT DOCUMENTS 826904 4/1938 France ..... 416/124

1575483 7/1969 France ..... 440/80

185336 10/1936 Switzerland ..... 440/80

*Primary Examiner*—Galen L. Barefoot

*Assistant Examiner*—Jesûs D. Sotelo

*Attorney, Agent, or Firm*—McGlew and Tuttle

[57] ABSTRACT

A marine contra-rotating propeller apparatus for propelling a ship by contra-rotating propellers is characterized by the provision of an inner shaft having one end directly coupled to an output shaft of a main diesel engine and the other end to which an outside propeller is mounted and an outer shaft having one end coupled to the inner shaft through a reversing transmission mechanism and an elastic coupling and the other end to which an inside propeller is mounted.

8 Claims, 7 Drawing Figures

MARINE CONTRA-ROTATING PROPELLER APPARATUS

BACKGROUND OF THE INVENTION (1) Field of the Invention

The present invention relates to a marine contra-rotating propeller apparatus which includes an outside propeller for propelling a ship and an inside propeller which is rotated in the opposite direction to that of the outside propeller at the same revolution speed as that of the outside propeller.

(2) Description of the Prior Arts

A conventional marine contra-rotating propeller apparatus is now described, by way of example, with reference to FIG. 1. The marine contra-rotating propellers are composed of the combination of a stern-side or outside propeller 1 and a bow-side or inside propeller 2. The torque delivered by a main diesel engine 7 is transmitted to a planetary gear mechanism 5 through an elastic coupling 6 which eliminates any variation component or vibration component of the torque. The torque transmitted to the planetary gear mechanism 5 rotates an inner shaft 4 through a spur gear meshing with a planet gear and the revolution of the planet gear is taken out from an outer shaft 3 so that the outer shaft 3 is rotated in the opposite direction to that of the inner shaft 4 and a substantially equal torque is transmitted to both the shafts 3 and 4. The propellers 1 and 2 are rotated in the opposite directions to each other at the substantially same revolution speed depending on the design of a shape of the propellers. In other words, the contra-rotating propellers are designed to be rotated in the opposite directions to each other with the torque and the revolution speed being substantially equal and with the high efficiency of propulsion.

The thrust developed by the outside propeller 1 and the inside propeller 2 is transmitted through the inner shaft 4 and the outer shaft 3 to a ship body by means of a thrust bearing 8. The elastic coupling 6 smooths the variation component of the torque and serves to protect the gears of the planetary gear mechanism 5 for reversing the revolution direction.

However, while the conventional marine contra-rotating propeller apparatus is designed so that the revolution directions of both the propellers are opposite and the revolution speed and the torque are substantially equal in order to optimize the efficiency of propulsion, the adoption of the planetary gear mechanism shown in the figure produces the following drawbacks:

(I) If both the propellers 1 and 2 of the contra-rotating propeller apparatus are rotated in the opposite directions to each other at the same revolution speed using the planetary gear mechanism 5, the number of revolutions of the main diesel engine is reduced (the reduction ratio is 3 or more) to be transmitted to the propellers. Accordingly, if a low-speed diesel engine having an output shaft rotated at a low revolution speed (for example, 70 revolutions/minute) is used, the revolution of the propellers is reduced below a desired optimum revolution speed and the efficiency of propulsion is deteriorated. If a middle-speed diesel engine having an output shaft rotated at a relatively high revolution speed (for example, 450 revolutions/minute) is used, it can not obtain the advantages of the low-speed diesel engine such as good fuel consumption rate, easiness in maintenance and usability of bad quality fuel although the revolution of the propellers can be set near a desired maximum revolution speed and the improved efficiency of propulsion can be expected.

Further, since the speed reduction ratio of the input side and the output side, that is, the outer shaft 3 and the inner shaft 4 and the torque ratio of the outer shaft 3 and the inner shaft 4 in the planetary gear mechanism 5 are related to each other, it is necessary that the main diesel engine be provided at its output shaft with a separate speed reduction or increase device to adjust the revolution of the planetary gear mechanism at its input side so that the torque ratio is optimized. (Since the main diesel engine possesses a rated output power and revolution speed, a continuous revolution speed can not be selected.)

(II) Recently, a main engine in a large ship mainly uses a low-speed diesel engine due to the above advantages. Since the low-speed engine is directly coupled to the propeller through a shaft generally, the main engine contains a thrust bearing therein in a standard configuration. If the planet gear is disposed between the main diesel engine and the propeller, the thrust bearing is required to be provided between the propeller and the planet gear. Consequently, the thrust bearing in the main engine merely serves to stop the movement of a crank shaft of the main diesel engine and the capacity thereof is vainly too large. (In FIG. 1, the thrust bearing 8 receives the thrust of the propellers 1 and 2 while the thrust bearing (not shown) in the main engine does not receive the thrust of the propellers.)

SUMMARY OF THE INVENTION

The first embodiment of the invention concerns a marine contra-rotating propeller apparatus for propelling a ship attained in view of the above facts. The invention is characterized in that an output shaft of a main diesel engine is directly coupled to an outside propeller through an intermediate inner shaft and an inner shaft, and an output from the engine is derived through a flanged friction sleeve coupling mounted on the intermediate inner shaft and which is coupled to an inside propeller through an elastic coupling, a reversing transmission mechanism and an outer shaft so that the thrust of the outer shaft produced by the inside propeller is transmitted to a thrust bearing on the intermediate inner shaft and the thrust of the inner and outer shafts are transmitted to a thrust bearing contained within the main diesel engine. It is an object of the invention to provide a marine contra-rotating propeller apparatus for propelling a ship using a low-speed main diesel engine for eliminating the above drawbacks and in which the revolution performance for driving the contra-rotating propellers and the thrust supporting performance are enhanced with simple structure.

In the first embodiments of the invention, since the outside propeller is directly coupled through the intermediate inner shaft and the inner shaft to the main diesel engine to be driven by means of the engine of which the output is derived through the flanged friction sleeve coupling on the intermediate inner shaft and the outer shaft is inversely rotated through the elastic coupling and the reversing transmission mechanism to rotate the inside propeller, the reverse revolution, the revolution speed and the torque distribution between the inner shaft for the outside propeller and the outer shaft for the inside propeller can be freely obtained and the revolution performance for driving the contra-rotating propellers is remarkably improved. A low-speed main diesel engine is adopted so that it can be effectively utilized and the characteristics thereof can be exhibited. Further, since the thrust acting on the outer shaft from the inside propeller is transmitted to the thrust bearing on the intermediate inner shaft and transmitted to the thrust bearing contained in the main diesel engine together with the thrust acting on the inner shaft from the outside propeller, the revolution performance for driving the contra-rotating propellers is remarkably improved. In addition, the reversing transmission mechanism and the gears are protected by the output transmission performance exhibited by means of the flanged friction coupling and the elastic coupling so that the revolution performance for driving the contra-rotating propellers is further improved and reliability of the apparatus is extremely improved.

The second embodiment of the invention concerns a marine contra-rotating propeller apparatus eliminating the above drawbacks in the conventional apparatus. The marine contra-rotating propeller apparatus in which an outside propeller is directly connected to an inner shaft coupled to a main diesel engine and an inside propeller is coupled to an outer shaft coupled to the intermediate portion of the inner shaft through an elastic coupling, an input outer shaft and a reversing transmission mechanism, is characterized in that the reversing transmission mechanism is formed of a planetary gear mechanism comprising a sun gear interposed between the input outer shaft and the outer shaft, a small planet gear meshed with the sun gear, a large planet gear coupled to the small planet gear and an inner gear meshed with the large planet gear. It is an object of the invention to provide the marine contra-rotating propeller apparatus eliminating the above drawbacks in which the reversing transmission mechanism interposed between the input outer shaft and the outer shaft forming an inside propeller driving mechanism is formed of a special planetary gear mechanism which can allow the movement in the thrust direction of the outer shaft and rotate the input outer shaft and the outer shaft at the same revolution speed.

The second embodiment of the invention is constructed as described above. The outside propeller is directly connected to the inner shaft which is coupled to the main diesel engine and the inside propeller is connected to the outer shaft which is coupled to the intermediate portion of the inner shaft through the elastic coupling. The input outer shaft and the reversing transmission mechanism which is formed of the planetary gear mechanism including the sun gear interposed between the input outer shaft and the outer shaft, the small planet gear meshed with the sun gear, a large planet gear coupled to the small planet gear, and the inner gear on the side of the outer shaft meshed with the large planet gear. Variations in torque are smoothed through the elastic coupling connected to the intermediate portion of the inner shaft and the torque is transmitted to the input outer shaft and the construction of the large planet gear coupled to the small planet gear in the planetary gear mechanism allows each gear to be formed of a spur gear and forms the reversing function. The revolution speed and the torque distribution for the input outer shaft and the outer shaft can be remarkably freely set up and the special planetary gear mechanism sufficiently absorbs the movement in the thrust direction of the outer shaft to protect the gears. The inverse revolution, the revolution speed and the torque distribution of the inside propeller for the outside propeller are extremely enhanced, and the revolution performance and the reliability of the contra-rotating propellers are remarkably improved.

Further, the planetary gear mechanism can be formed into a relatively simple and can small structure and be provided to be inexpensive since the large planet gear is merely provided. The excellent propeller revolution performance as described above allows the low-speed main diesel engine possessing various characteristics to be adopted and be effectively utilized, and further the characteristics of a conventional bevel gear group is exhibited.

Other objects and advantages of the present invention will be apparent from the following description in connection with drawings.

DETAILED DESCRIPTION OF THE INVENTION

An embodiment of the present invention is now described with reference to the drawings.

Figure 1:
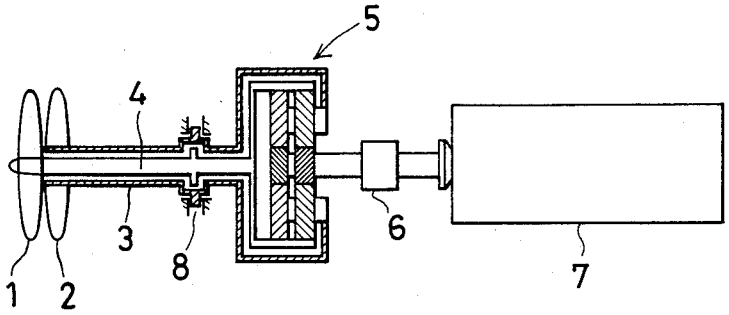
FIG.1 PRIOR ART
FIG. 1 is a longitudinal sectional view of a construction showing a prior art marine contra-rotating propeller apparatus.
Figure 2:
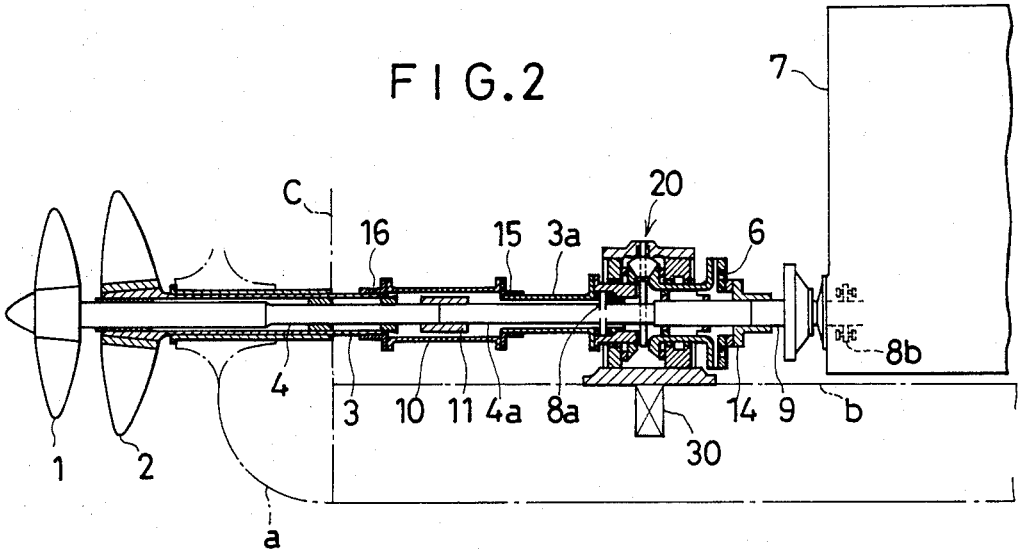
FIG. 2 is a longitudinal sectional view of an overall construction showing a first embodiment of the present invention.
Figure 3:
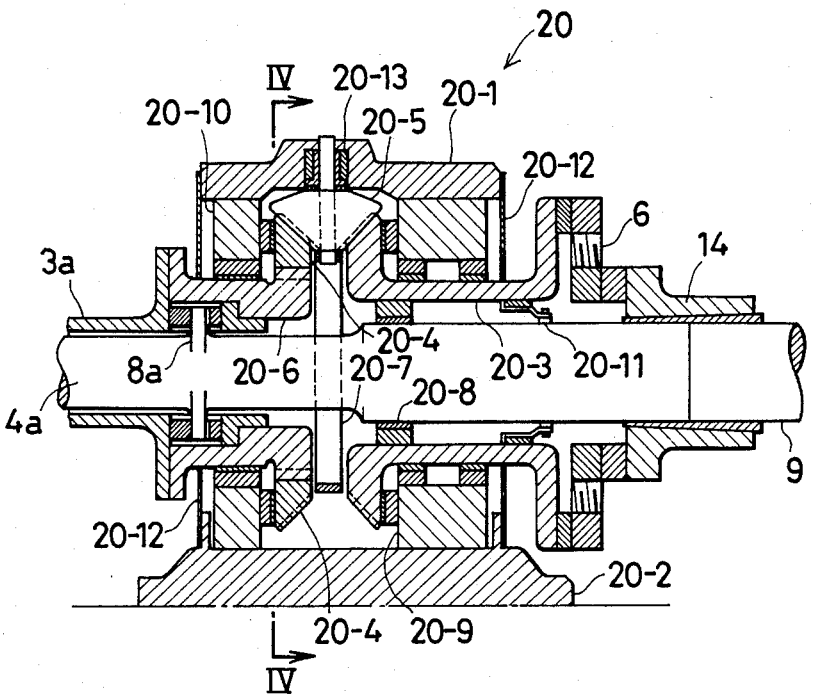
FIG. 3 is an enlarged longitudinal sectional view of a reversing transmission mechanism in FIG. 2.
Figure 4:
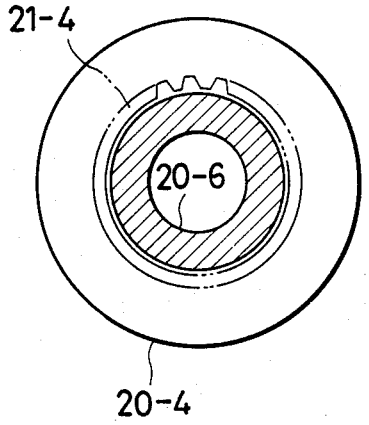
FIG. 4 is a sectional view of a portion taken along line IV—IV in FIG. 3.

FIGS. 2 to 4 show a first embodiment of the present invention. In the drawings, numeral 1 denotes an outside or stern-side propeller, 2 an inside or bow-side propeller, 3 an outer shaft to which the inside propeller 2 is coupled, and 4 an inner shaft to which the outside propeller 2 is coupled. An output shaft 9 of a low-speed main diesel engine 7 is directly coupled to the outside propeller 1 through a flanged friction sleeve coupling 14, an intermediate inner shaft 4*a*, a friction sleeve coupling 11 and the inner shaft 4. Further, the output shaft 9 is coupled to the inside propeller 2 through an elastic coupling 6, a reversing transmission mechanism 20, an intermediate outer shaft 3*a* and the outer shaft 3.

More particularly, the low-speed main diesel engine 7 and the reversing transmission mechanism 20 are installed on a tank top b forming a double bottom which is part of a ship body a. The inner shaft 4 and the outer shaft 3 for rotating the contra-rotating propellers, that is, the outside propeller 1 and the inside propeller 2, respectively, penetrate a rear partition wall c forming part of the ship body a.

The output shaft 9 of the main diesel engine 7 is coupled through the friction sleeve coupling 14 to the intermediate inner shaft 4*a* which is coupled through the friction sleeve coupling 11 to the inner shaft 4, so that the torque and the thrust are transmitted through friction.

The torque is transmitted to the inside propeller 2 through the friction sleeve coupling 14, the elastic coupling 6, the reversing transmission mechanism 20, the intermediate outer shaft 3*a*, a sleeve 10 and the outer shaft 3. Flanged friction couplings 15 and 16 are interposed between the intermediate outer shaft 3*a* and the sleeve 10 and the sleeve 10 and the outer shaft 3, respectively, so that the torque and the thrust are transmitted through friction.

The friction couplings 11, 14, 15 and 16 are of a known oil injection type to which oil pressure is loaded and which can be fitted up and opened.

The thrust developed by the inside propeller 2 is transmitted to the intermediate inner shaft 4*a* through the outer shaft 3, the sleeve 10, the intermediate outer shaft 3*a*, and a thrust bearing 8*a* of the intermediate inner shaft 4*a*. On the other hand, the thrust developed by the outside propeller 1 is transmitted to the inner shaft 4 and the intermediate inner shaft 4*a* and is applied to the thrust bearing 8*b* contained in the main diesel engine 7 together with the thrust of the inside propeller 2, whereby both the thrusts are transmitted to the ship body.

As shown in FIGS. 3 and 4, the reversing transmission mechanism 20 includes a casing 20-1, a substrate 20-2, an input bevel gear 20-3, an output bevel gear 20-4, a reversing bevel gear 20-5, a fit or spline gear 20-6, a ring 20-7, an intermediate inner shaft bearing 20-8, a bevel gear bearing 20-9, a bevel gear (with fit teeth) bearing 20-10, an oil seal ring 20-11, an oil stop cover 20-12 and a reversing bevel gear bearing 20-13.

The reversing bevel gears 20-5 are mounted to be capable of rotating on the inner surface of the casing 20-1 and the number of the gears 20-5 are sufficient to cause the torque of the main diesel engine 7 to be transmitted to the inside propeller 2.

The torque transmitted to the flanged friction sleeve coupling 14 from the output shaft 9 of the main engine is transmitted to the intermediate inner shaft 4*a* and also is transmitted to the elastic coupling 6 to be transmitted to the input bevel gear 20-3 so that the variation component or the vibration component thereof is smoothed.

The output bevel gear 20-4 is provided with fit or spline teeth 21-4 as its inner teeth and the inner teeth are meshed with outer teeth of the fit or spline gear 20-6 slidably in the axial direction thereof (refer to the sectional view shown in FIG. 4). With the arrangement, even if the fit gear 20-6 moves within clearance of the thrust bearing 8*a* at the side of the intermediate inner shaft upon forward and backward movement of the ship, it is designed so that the fit or spline operation between the bevel gear group 20-3, 20-4 and 20-5 does not fail.

Thus, one half of the torque of the main diesel engine 7 is transmitted to the inside propeller 2.

The bevel gear group 20-3, 20-4 and 20-5 and the fit gear 20-6 are properly supported by the bearings 20-9, 20-10 and 20-13. The intermediate inner shaft 4*a* is supported by the bearing 20-8 which has no relative speed except the vibration component when the shaft is rotated at a constant speed.

The inside of the reversing transmission mechanism 20 is sealed by the oil seal ring 20-11 and the oil stop cover 20-12, and the gear and the bearing are properly lubricated with oil. The oil falls into a sump 30 without leakage to the outside and is recirculated by a pump.

The inner and outer shafts 4 and 3 are supported by bearings which are properly lubricated with oil or seawater.

The friction coupling 15 can be opened so that the sleeve 10 can be slidably moved forwardly to the bow side in the axial direction and the inner friction sleeve coupling 11 can be opened.

The friction coupling 16 can be opened so that the inner and outer shaft 4 and 3 can be extracted from the outside of the ship a. Further, if the flanged friction sleeve coupling 14 is opened by being moved toward the bow side in a sliding manner and the casing 20-1 divided into two upper and lower portions in the axial direction and the bearings 20-9 and 20-10 are opened, the intermediate inner and outer shafts 4*a* and 3*a* can be inspected for maintenance.

If the intermediate inner shaft 4*a* is long, the output shaft 9 and the intermediate inner shaft 4*a* can be coupled by another friction sleeve coupling instead of the coupling 14. In this case, the coupling 14 may be used as a friction coupling for the intermediate outer shaft 3.

The reversing bevel gear 20-5 mounted on the inner surface of the casing 20-1 is coupled at its end to the ring 20-7 for reinforcement. However, if the supporting reinforcement for the reversing bevel gear 20-5 is insufficient, the ring 20-7 may be coupled to the casing 20-1 to further reinforce the support of the bevel gear.

Since the embodiment of the present invention comprises the reversing transmission mechanism 20 i.e. the bevel gear mechanism as shown in FIGS. 3 and 4, the revolution transmission performance such as the inverse revolution, the revolution speed and the torque distribution is improved, the fuel consumption ratio is good and the maintenance control is easy. The low-speed diesel engine which can use a bad quality fuel oil can be effectively utilized and its merit is sufficiently obtained.

The outside propeller 1 is directly coupled to the output shaft 9 of the low-speed main diesel engine 7 through the intermediate inner shaft 4*a* and the inner shaft 4. On the other hand, since the torque or the output is derived from the intermediate inner shaft having less twisted vibration and the output shaft 9 of the main engine through the flanged friction sleeve coupling 14 to the inside propeller 2 which is coupled through the elastic coupling 6 and the bevel gear group of the reversing transmission mechanism 20 to the main engine 7, the respective contra-rotating propellers are rotated in the opposite directions to each other at the same revolution speed with the same torque distribution independently of the load of the propeller, so that the optimum design of the contra-rotating propellers can be made freely.

Further, the capacity of the elastic coupling 6 and the reversing transmission mechanism 20 may be about half of the capacity of driving the inside propeller or the output of the main diesel engine. Since the outside propeller is directly coupled through the inner shaft and the intermediate inner shaft to the main diesel engine, the elastic coupling and the bevel gear are not required in these shafts and hence its structure can be simple.

In addition, since the intermediate inner shaft 4*a* is directly coupled to the main diesel engine 7 and the thrusts of the inner and outer shaft are received by the thrust bearing 8*b* contained in the low-speed main diesel engine through slide bearing 8*a* to be received by the ship body, the support performance of the thrust can be remarkably improved and the bevel gear group of the reversing transmission mechanism 20 can be protected together with the elastic coupling 6.

In the conventional planetary gear system, the unbalance of torque occurs in each propeller and the revolution speed for each propeller is different. At an extreme, both propellers may be rotated in the same direction. In the revolution transmission driving mechanism of the present embodiment, each contra-rotating propeller is always rotated in the opposite direction at the same revolution speed and the transient characteristic upon the increase and reduction of the speed and the backward movement is extremely improved. The driving mechanism is relatively inexpensive as a whole and the revolution driving performance and the reliability of the contra-rotating propellers are remarkably improved.

A second embodiment of the present invention is now described.

Figure 5:
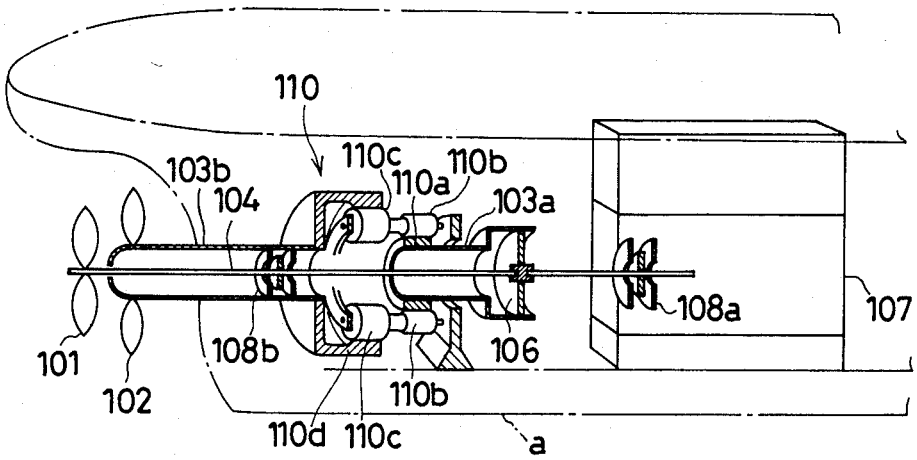
FIG. 5 illustrates an overall construction according to a second embodiment of the present invention.
Figure 6:
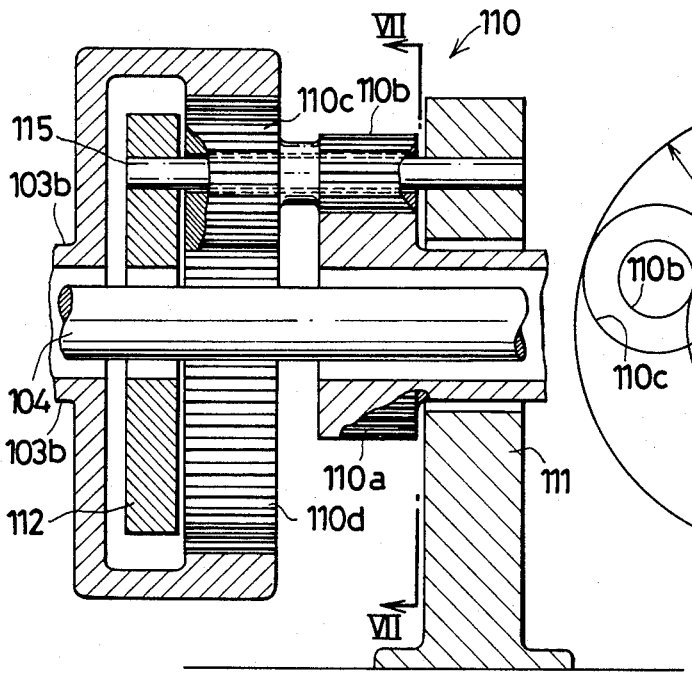
FIG. 6 is an enlarged longitudinal sectional view of a reversing transmission mechanism in FIG. 5.
Figure 7:
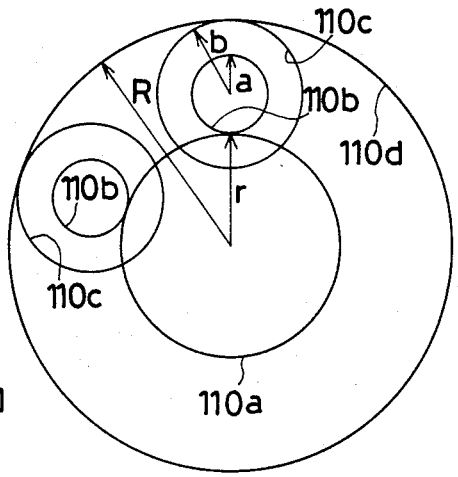
FIG. 7 illustrates an arrangement of each gear taken along line VII—VII in FIG. 6.

FIGS. 5 to 7 show the second embodiment of the present invention. In the drawings, reference letter a denotes a ship body, reference numeral 101 denotes an outside propeller, 102 an inside propeller, 103*a* an input outer shaft supplied with the torque derived through an elastic coupling 106 disposed on the intermediate portion of an inner shaft 104, 103*b* an outer shaft coupled through a reversing transmission mechanism 110 to the input outer shaft 103*a* and to which the inside propeller 102 is coupled, 104 an inner shaft coupled directly to the output shaft of a low-speed main diesel engine 107 and to which the outside propeller 101 is directly coupled, 108*a* a thrust bearing of the output shaft coupled to one end of the inner shaft 104 contained in the engine 107, and 108*b* a thrust bearing of the inner shaft 104, the thrust bearing 108*b* having a function of transmitting the thrust of the outer shaft 103*b* to the inner shaft 104.

The reversing transmission mechanism 110 comprises a planetary gear mechanism composed of a sun gear 110*a* which is fixedly mounted on an end of the input outer shaft 103*a*, a small planet gear 110*b* meshed with the sun gear 110*a*, a large planet gear 110*c* mounted on the same shaft as that of the small planet gear 110*b*, and a spur gear 110*d* fixedly mounted on the basal portion of the outer shaft 103*b* and meshed with the large planet gear 110*c* as shown in FIG. 6. A planetary shaft 115 common to the small planet gear 110*b* and the large planet gear 110*c* is supported on a fixed stand 111 and a disc 112 as shown in the drawing. The necessary number of pairs of the large and small planet gears are provided to transmit the torque to the inside propeller 102.

In this manner, the torque transmitted to the input outer shaft 103*a* through the elastic coupling 106 from the intermediate portion of the inner shaft 104 is smoothed in its variation component by the action of the elastic coupling 106 and is transmitted to the sun gear 110*a* through the input outer shaft 103*a*. The sun gear 110*a* rotates the large planet gear 110*c* as well as the small planet gear 110*b*, and the large planet gear 110*c* rotates the spur gear 110*d* and the outer shaft 103*b*, so that the outer shaft 103*b* is rotated in the opposite direction to that of the input outer shaft 103*a*.

Each of the above gears is formed of a spur gear, and the sun gear 110*a* and the inner gear 110*d* are rotated in the opposite directions to each other at the same revolution speed by varying the magnitude or the gear ratio of the large planet gear 110*c* and the small planetary gear 110*b*. As shown in FIG. 7, when the radii of the sun gear 110*a*, the inner gear 110*d*, the small planet gear 110*b* and the large planet gear 110*c* are r, R, a and b, respectively, the sun gear 110*a* and the inner gear 110*d* i.e. the input outer shaft 103*a* and the outer shaft 103*b* are rotated in the opposite directions to each other at the same revolution direction if the radii of the respective gears are made to safisfy the following equation (1).

$$\left.\begin{aligned} R &= a + b + r \\ \frac{b}{a} &= \frac{R}{r} \end{aligned}\right\} \qquad (1)$$

In the prior art planetary gear mechanism, the revolution speeds of the input shaft and the output shaft can not be equal to each other.

For example, if a:b:r:R = 1:2:3:6, the above equation can be satisfied. Further, the ratio can be freely set to the best condition in connection with the structure of both the propellers.

With the above structure of the embodiment, the outside propeller 101 is directly driven through the inner shaft 104 from the low-speed main diesel engine 107 and the output torque is derived to the input outer shaft 103*a* while smoothing the variation component through the elastic coupling 106 from the intermediate portion of the inner shaft 104. With the structure that the large planet gear 110*c* is coupled to the same shaft as that of the small planet gear 110*b* in the reversing transmission mechanism 110, the input outer shaft 103*a* and the outer shaft 103*b* are rotated in the opposite directions to each other, and the same revolution speed and the same torque distribution of the outer shaft 103*b* for the inner shaft 103*a*, that is, the inside propeller 102 for the outside propeller 101 can be freely established and hence the revolution propulsion performance and reliability of the contra-rotating propellers are improved remarkably.

Since the inner gear 110*d* and the large planet gear 110*c* are meshed with each other as in spur gears and can move freely in the thrust direction of the outer shaft 103*b* to absorb the thrust, the gears of the planetary gear mechanism 110 are protected and the function of the thrust bearings 108*b* and 108*a* which receive the thrust from the outer shaft 103*b* and the inner shaft 104 are sufficiently exhibited.

The function of the large planet gear is added to the function of the prior art planet gear which has been mainly used as a propulsion apparatus for a large ship and consequently the contra-rotating propeller apparatus which has the features in the prior art and completely eliminates the drawbacks in the prior art is attained with a extremely simple and small structure. Further, a low-speed main diesel engine which is superior in the fuel consumption and the maintenance control and can use a bad quality fuel oil can be used and effectively utilized.

While the sun gear 110*a* is used at the input side and the inner gear 110*d* is used at the output side in the above embodiment, it is not limited to such an arrangement but the same effect can be obtained even if the arrangement is reversed. Although the planetary shaft 115 for a plurality of the large planet gears 110*c* and the small planetary gears 110*b* is coupled at its end to the disc 112 for reinforcement, the disc 112 can be designed to be coupled to the fixed stand 111 in order to increase the reinforcement.

What is claimed is:

1. A marine contra-rotating propeller apparatus for propelling a ship by contra-rotating propellers comprising an inner shaft having one end which is directly coupled to an output shaft of a main diesel engine and the other end to which an outside propeller is mounted, and an outer shaft having one end which is coupled to said inner shaft through a reversing transmission mechanism and an elastic coupling and the other end to which an inside propeller is mounted, said reversing transmission mechanism comprising an input bevel gear coupled to said inner shaft through said elastic coupling, a reversing bevel gear meshing with said input bevel gear, an output bevel gear meshing with said reversing bevel gear, and a fit gear mounted fixedly on said outer shaft and having outer teeth meshing with the inner teeth of said output bevel gear slidably in the axial direction.

2. A marine contra-rotating propeller apparatus for propelling a ship by contra-rotating propellers comprising an inner shaft having one end which is directly coupled to an output shaft of a main diesel engine and the other end to which an outside propeller is mounted, and an outer shaft having one end which is coupled to said inner shaft through a reversing transmission mechanism and an elastic coupling and the other end to which an inside propeller is mounted, said reversing transmission mechanism comprising a sun gear coupled to said inner shaft through said elastic coupling, a small planet gear meshing with said sun gear, a large planet gear coupled to said small planet gear and a spur gear coupled to said outer shaft and having inner teeth meshing with said large planet gear.

3. A marine contra-rotating propeller apparatus according to claims 1 or 2, comprising a flanged thrust bearing mounted on the outer periphery of said inner shaft to receive the thrust from said outer shaft so that the thrust of the propeller delivered to said outer shaft is transmitted to said inner shaft and the thrusts of the propellers delivered to said inner and outer shafts are combined to be transmitted to a thrust bearing mounted in the diesel engine.

4. A marine propeller apparatus for propelling a ship having a main diesel engine with an output shaft, comprising: an inner shaft having one end directly connected to the output shaft of the diesel engine; an outside propeller directly connected to an opposite end of said inner shaft; an elastic coupling connected to the output shaft of the diesel engine; reversing transmission means having an input connected to said elastic coupling and an output; an outer shaft mounted for rotation around said inner shaft and connected to said output of said reversing transmission means; an inside propeller connected to said outer shaft whereby with rotation of the output shaft of the diesel engine, said inside and outside propellers contra-rotate; and bearing means connected between said inner and outer shafts and to the ship for transferring thrust forces of said inside and outside propellers to the ship, said bearing means comprising a flanged thrust bearing connected between said inside and outside shafts for transmitting thrust of said inside propeller to said inner shaft, and a further thrust bearing connected between said inner shaft and the ship for transmitting thrust of both said inside and outside propellers to the ship, said reversing transmission means comprising a casing which is fixed to the ship, an input bevel gear rotatably mounted to said casing and connected to said elastic coupling for rotation, at least one reversing bevel gear mounted for rotation at a fixed location on said casing, said reversing bevel gear being meshed with said input bevel gear, an output bevel gear rotatably mounted to said casing and meshed with said at least one reversing bevel gear, and a spline gear connected to said output bevel gear for for rotation therewith and for axial movement with respect thereto, said spline gear being fixed to said outer shaft.

5. An apparatus according to claim 4, including a friction sleeve frictionally engaged over the output shaft of the diesel engine and over said inner shaft for fixing said inner shaft to the output shaft, said elastic coupling being connected to said friction sleeve.

6. An apparatus according to claim 5, wherein said input and output bevel gears and said at least one reversing bevel gear each have a selected radius so that said inner and outer shafts rotate at equal and opposite speeds.

7. A marine propeller apparatus for propelling a ship having a main diesel engine with an output shaft, comprising: an inner shaft having one end directly connected to the outer shaft of the diesel engine; an outside propeller directly connected to an opposite end of said inner shaft; an elastic coupling connected to the output shaft of the diesel engine; reversing transmission means having an input connected to said elastic coupling and an output; an outer shaft mounted for rotation around said inner shaft and connected to said output of said reversing transmission means; an inside propeller connected to said outer shaft whereby with rotation of the output shaft of the diesel engine, said inside and outside propellers contra-rotate; and bearing means connected between said inner and outer shafts and to the ship for transferring thrust forces of said inside and outside propellers to the ship, said bearing means comprising a flanged thrust bearing connected between said inside and outside shafts for transmitting thrust of said inside propeller to said inner shaft, and a further thrust bearing connected between said inner shaft and the ship for transmitting thrust of both said inside and outside propellers to the ship, said reversing transmission means comprising a fixed support connected to the ship, a further inner shaft connected to said elastic coupling, a sun gear connected to said further inner shaft, a planet gear shaft mounted to said fixed support, a pair of axially spaced connected together planet gears rotatably supported to said fixed support on said planet gear shaft, one of said planet gears meshed with said sun gear, a spur gear having inside teeth meshed with other of said planet gears, said spur gear being fixed to said first-mentioned inner shaft.

8. An apparatus according to claim 7, wherein said gear having a radius r, said spur gear has an inside radius R, said one planet gear meshed with said sun gear having a radius a, said other planet gear meshed with said spur gear having a radius b, and said radiuses satisfying the equation $R=a+b+r$ and $b/a=R/r$, whereby said first-mentioned outer shaft and said inner shaft rotate at equal and opposite speeds.

* * * * *